US005964276A

United States Patent [19]

Dompas et al.

[11] Patent Number: 5,964,276

[45] Date of Patent: Oct. 12, 1999

[54] EDGE-DAM BLOCKS HAVING ABUTTABLE UPSTREAM AND DOWNSTREAM FACES MESHING WITH EACH OTHER IN MATING RELATIONSHIP FOR CONTINUOUS CASTING OF MOLTEN METALS—METHODS AND APPARATUS

[75] Inventors: John Dompas, Olen, Belgium; Stanley E. Aylward, Fairfax; R. William Hazelett, Colchester, both of Vt.

[73] Assignee: Hazelett Strip-Casting Corporation, Colchester, Vt.

[21] Appl. No.: 09/122,014

[22] Filed: Jul. 24, 1998

[51] Int. Cl.[6] ..... B22D 11/06

[52] U.S. Cl. ..... 164/452; 164/430; 164/431

[58] Field of Search ..... 164/431, 430, 164/452

[56] References Cited

U.S. PATENT DOCUMENTS

| | | | |
|---|---|---|---|
| 2,904,860 | 9/1959 | Hazelett | 22/57.4 |
| 3,036,348 | 5/1962 | Hazelett et al. | 22/57.4 |
| 3,865,176 | 2/1975 | Dompas et al. | 164/87 |
| 3,955,615 | 5/1976 | Dompas et al. | 164/278 |
| 4,155,396 | 5/1979 | Dompas et al. | 164/431 |
| 4,694,899 | 9/1987 | Wood et al. | 164/452 |
| 4,934,441 | 6/1990 | Wood et al. | 164/452 |

FOREIGN PATENT DOCUMENTS

| | | | |
|---|---|---|---|
| 63-132751 | 6/1988 | Japan | 164/430 |

*Primary Examiner*—Patrick Ryan
*Assistant Examiner*—Anjan Dey
*Attorney, Agent, or Firm*—G. Kendall Parmelee; Parmelee & Bollinger, LLP

[57] ABSTRACT

Edge-dam blocks assembled with their upstream faces in keyed mating interengagement with downstream faces of adjacent blocks form an endless edge dam revolvable in a preselected path for defining a boundary of a moving-mold casting region. The edge dam keeps molten metal in the casting region. Upstream and downstream faces of adjacent blocks have mutually complementary shapes for minimizing intrusion of molten metal between abutting blocks. Keying engagement between abutting blocks prevents relative translational slippage of blocks toward or away from molten metal. An abuttable face on each block has at least one protrusion such as an integral elongated key extending perpendicularly to a casting belt associated with the casting region, or the protrusion includes two round pins having projecting tapered ends. Another abuttable face has a recess such as a keyway for snugly receiving a key on an adjacent block or has two tapered recesses for snugly receiving two tapered projections of an adjacent block. External edges and root fillets of keys (and shoulders and root fillets of keyways) are radiused with radii in a range between about 1.2 and about 3 millimeters. Blocks' lower surfaces are shown having slots for receiving a tension member. A key's lower end may be undercut near the slot for relieving stress concentration. A pair of parallel undercut fillets are shown extending along opposite sides of a key. They have a radius in a range from about 3 to about 5 millimeters.

27 Claims, 13 Drawing Sheets

EDGE-DAM BLOCKS HAVING ABUTTABLE UPSTREAM AND DOWNSTREAM FACES MESHING WITH EACH OTHER IN MATING RELATIONSHIP FOR CONTINUOUS CASTING OF MOLTEN METALS—METHODS AND APPARATUS

FIELD OF THE INVENTION

This invention is in the field of continuous casting of molten metal accomplished by pouring the metal into continuous-moving-belt metal-casting machines employing one or more endless, flexible, moving heat-conducting casting belts, e.g., metallic casting belts. Such a belt or belts define a moving mold cavity or mold space along which the belt or belts are continuously moving whereby successive areas of each belt enter the mold cavity, move along the mold cavity and subsequently leave the mold cavity. The product of such continuous casting is normally a continuous slab, plate, sheet or strip, or a generally rectangular continuous bar.

Particularly, this invention relates to keyed edge-dam or side-dam blocks which are configured for assembly with successive adjacent blocks in keyed interengagement on an endless flexible loop member such as a flexible ribbon, band, strap, cables, wire ropes of the like to form endless looped edge-dams, and this invention also relates to the assembled edge-dams.

BACKGROUND OF THE INVENTION

A flexible edge-dam or side-dam chain is made by stringing discrete separate edge-dam blocks, usually of metal, onto a looped endless flexible metallic tension member such as a ribbon, followed by welding that ribbon into a loop before assembling the last edge-dam block, using the split-block technique described in U.S. Pat. No. 3,865,176 of Dompas et al. The looped edge dams are normally used in pairs which travel along with the belt or belts to complete the defining and sealing of a mold cavity or space. Alternatively, a pair of wire ropes may replace the ribbon.

The edge dams of the prior art are described in the patents referenced herein, which are all assigned to the same assignee as the present invention. The mutually abutting faces of the dam blocks have normally been flat or effectively lying in one plane as shown in the referenced patents. This plane of abutment is normally perpendicular to the mold cavity. On the whole, these prior-art edge dams have nearly solved the above problem of presenting to the freezing metal a continuous, unbroken surface to be cast against. However, the strap or wire ropes which carry the blocks and unite them into a chain require to be fitted loosely into the corresponding slots or holes in the blocks in order to permit self-adjustment of each block along the length of the strap or wire ropes. Yet, this needed looseness may permit tilting of the blocks when in the casting section of the casting machine, especially the tilting of tall blocks used for casting thick sections such as wire bar.

The looped edge dams should present to the molten metal a smooth, continuous, substantially unbroken surface. Slightly tilted or cocked dam blocks cause the edge of a frozen metal slab to be correspondingly jagged or discontinuous. Then cracking or breaking may occur at such points of stress concentration, whether immediately, or during rolling, or later during fabrication of finished products. The problem can be especially acute in casting the generally rectangular bar which is to be drawn into wire, notably copper wire. The intense wire-drawing process results in laps at such discontinuities and consequently slivers and cracks. Fine wire may break within the dies as a result, or wire may locally overheat in electrical service.

A second undesirable result of tilted or cocked edge-dam blocks is that uneven contact with stationary longitudinal edge-dam guides results. Such guides are used in the casting of bar shapes. They are a significant heat sink; by their contact with the outer faces of the passing edge-dam blocks, the guides extract heat and pass the heat to the cooling water in the channel drilled through each of them. Uneven contact between guides and dam blocks not only slows down the freezing process; the sharp discontinuities of cooling-rate between adjacent misaligned edge-dam blocks compounds the above-mentioned problems by adding crystalline discontinuities and internal stresses. Moreover, the resultant temperature differences cause the immediate rolling of the hot cast bar to be unevenly severe in hot work from point to point.

SUMMARY OF THE DISCLOSURE

We have found that the above problem of misalignment of edge-dam blocks, and the resulting detrimental discontinuities in the cast edge surfaces of a continuously cast product, can be solved or substantially overcome through shaping the mutually abutting transverse sides of the edge-dam blocks in ways which cause them to key together, i.e., to interlock or interengage in alignment, precisely facing each other when fully abutted. Any of many differing shapes of these abutting faces can accomplish this goal, so long as one face will mesh with a corresponding matrix surface of its neighboring block, and so long as the edges that are touched by molten metal will seal against the entry of molten metal. A preferred embodiment is that of an integral key or key-like tongue extending across the height of one abutting face and perpendicular to the plane of the casting belt or belts, this face meshing with a corresponding keyway in the abutting face in the neighboring edge-dam block. Another embodiment accomplishes a keying relationship by utilizing two pins in a face of each block, the two pins meshing with two corresponding sockets in the opposite face. Whatever meshing shape and corresponding matrix shape is used on any pair of adjacent blocks is applied to all the edge-dam blocks of an edge-dam chain.

BRIEF DESCRIPTION OF THE DRAWINGS

The accompanying drawings are part of this specification for the purpose of illustrating the principles of the invention.

Other objects, aspects, features and advantages of the present invention will become more fully understood from the following detailed description of the presently preferred embodiment considered in conjunction with the accompanying drawings, which are presented as illustrative and are not necessarily drawn to scale or orientation and are not intended to limit the invention. Corresponding reference numbers are used to indicate like components or elements throughout the various Figures. Large outlined arrows point "downstream" in a longitudinal (upstream-downstream) orientation and thus these arrows indicate the direction of product flow from entrance to exit. Simple straight one-line arrows show the direction of belt movement. Elongated outlined triangles indicate one uniform direction of motion of the edge dams and of their constituent blocks for purposes of explanation. The orientation of the blocks may be reversed upstream to downstream from the direction indicated in the drawings if done uniformly throughout any given looped edge dam.

DETAILED DESCRIPTION OF PREFERRED EMBODIMENTS

The specification will proceed in relation to a twin-belt casting machine 20, which typically has upper and lower carriages for revolving upper and lower casting belts 22 and 24 respectively.

Figure 1:
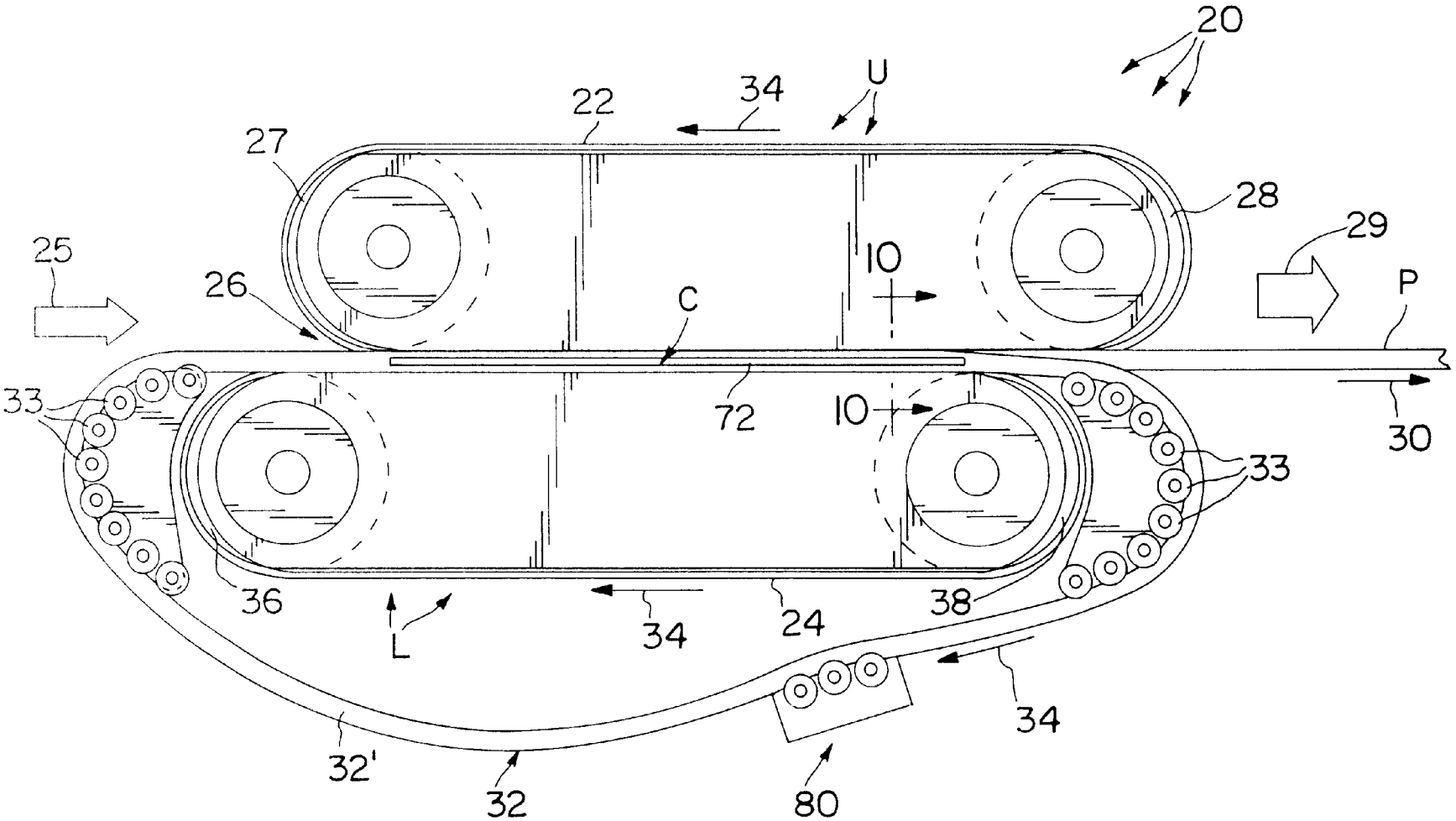
FIG. 1 is a side elevational view of a twin-belt continuous casting machine. As seen in this view, the looped edge dam could be either prior art or in accordance with the present invention.

FIG. 1 is a side elevation view of a twin-belt casting machine 20 as seen from the outboard side. The upper carriage is indicated at U and the lower carriage at L. Through molten-metal-feeding equipment (not shown) which is known in the art of continuous casting machines, molten metal is introduced into the entrance end 26 of the moving mold cavity or mold space C (FIG. 1). This introduction of molten metal is schematically indicated by the large open arrow 25 shown at the left in FIG. 1, and open arrow 29 at the right shows product flow. A continuously cast product P shown at the right in FIG. 1 emerges (arrow 30) from the exit end of moving mold cavity C.

The upper and lower sides of the moving mold cavity C are bounded by endless revolving upper and lower endless, flexible, thin-gauge, heat-conducting casting belts 22 and 24, respectively. These casting belts are normally fabricated from thin flexible sheet metal. The front or working surfaces of the casting belts may be suitably treated as known in the art. The reverse surfaces are cooled normally by fast-moving liquid coolant.

The two lateral sides of the moving mold cavity C are shown bounded by two revolving block-chain edge dams 32 as known in the art. (Only one edge dam 32 is seen in FIG. 1.) Lower belt 24 and block chains 32 revolve as shown by motion arrows 34 and are shown being guided by an arcuate arrangement of rollers 33 positioned upstream from an upstream lower pulley drum 36 opposite the entrance (upstream) end 26 of the moving mold cavity and around a similar arc of rollers 33 positioned downstream from a lower pulley drum 38 opposite the exit end of the moving mold cavity. Upper belt 22 is shown revolving around an upstream upper pulley drum 27 and around a downstream upper pulley drum 28. The structure and operation of such twin-belt casting machines is well known in the art of continuous-moving-belt metal-casting machines.

Figure 2:
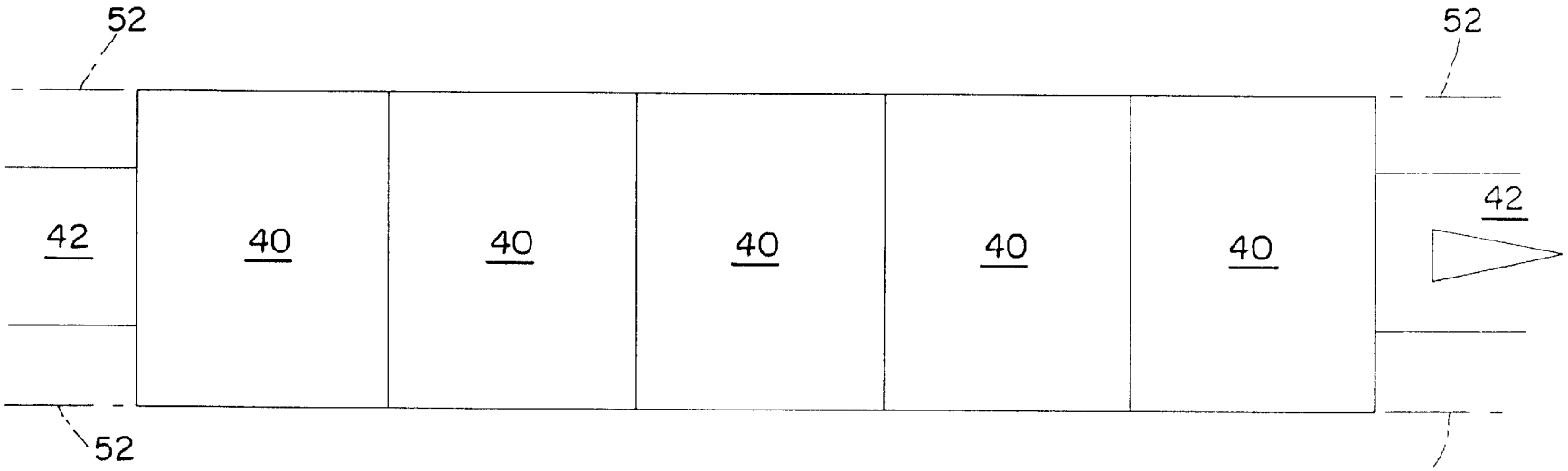
FIG. 2 PRIOR ART
FIG. 2 is a top view of a line of edge-dam blocks according to the prior art. Some blocks are here removed at the ends in order to reveal the flexible metallic strap which ties the blocks into a looped edge dam.
Figure 3:
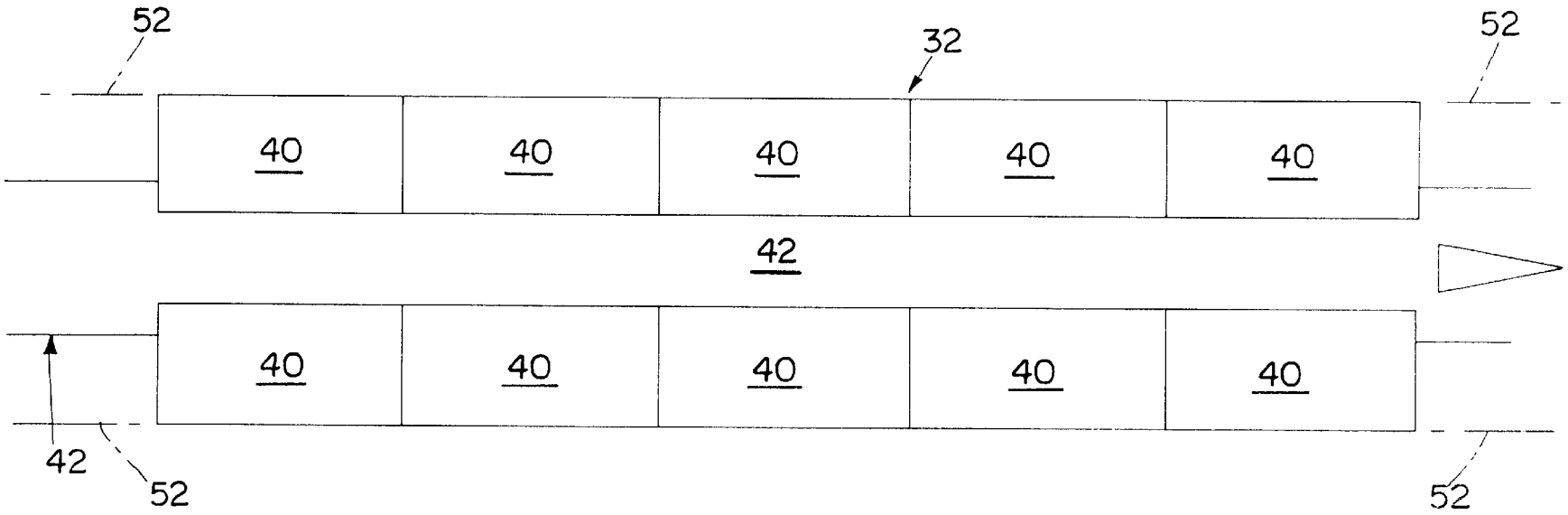
FIG. 3 PRIOR ART
FIG. 3 is a bottom view of a line of edge-dam blocks according to the prior art. Some blocks are here removed at the ends in order to reveal the flexible metallic strap which ties the blocks into a looped edge dam.

FIG. 2 is a top view of some conventional edge-dam blocks 40 strung upon a ribbon 42. FIG. 3 is the same as FIG. 2 but seen from below.

Figure 4:
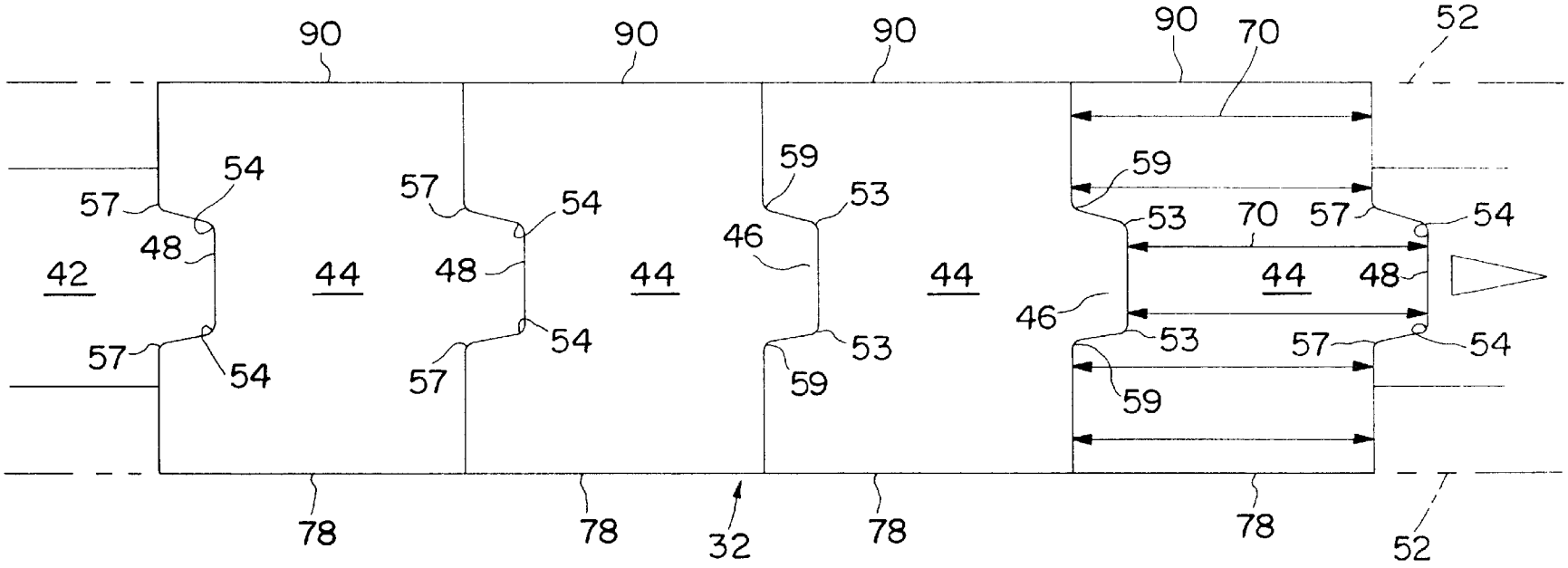
FIG. 4 is a top view of the edge-dam blocks as an example of the present invention. Blocks are here removed at the ends in order to reveal the flexible metallic strap which ties the blocks into a looped edge dam.

FIG. 4 is a top view of a preferred form of edge-dam blocks 44 according to the present invention. Corson bronze is a preferred material for those edge-dam blocks for the casting of copper bar, a process in which the present invention is important; see U.S. Pat. No. 3,865,176 of Dompas et al., which is assigned to the same assignee as the present invention. Steel edge-dam blocks are useful in casting aluminum.

Figure 5:
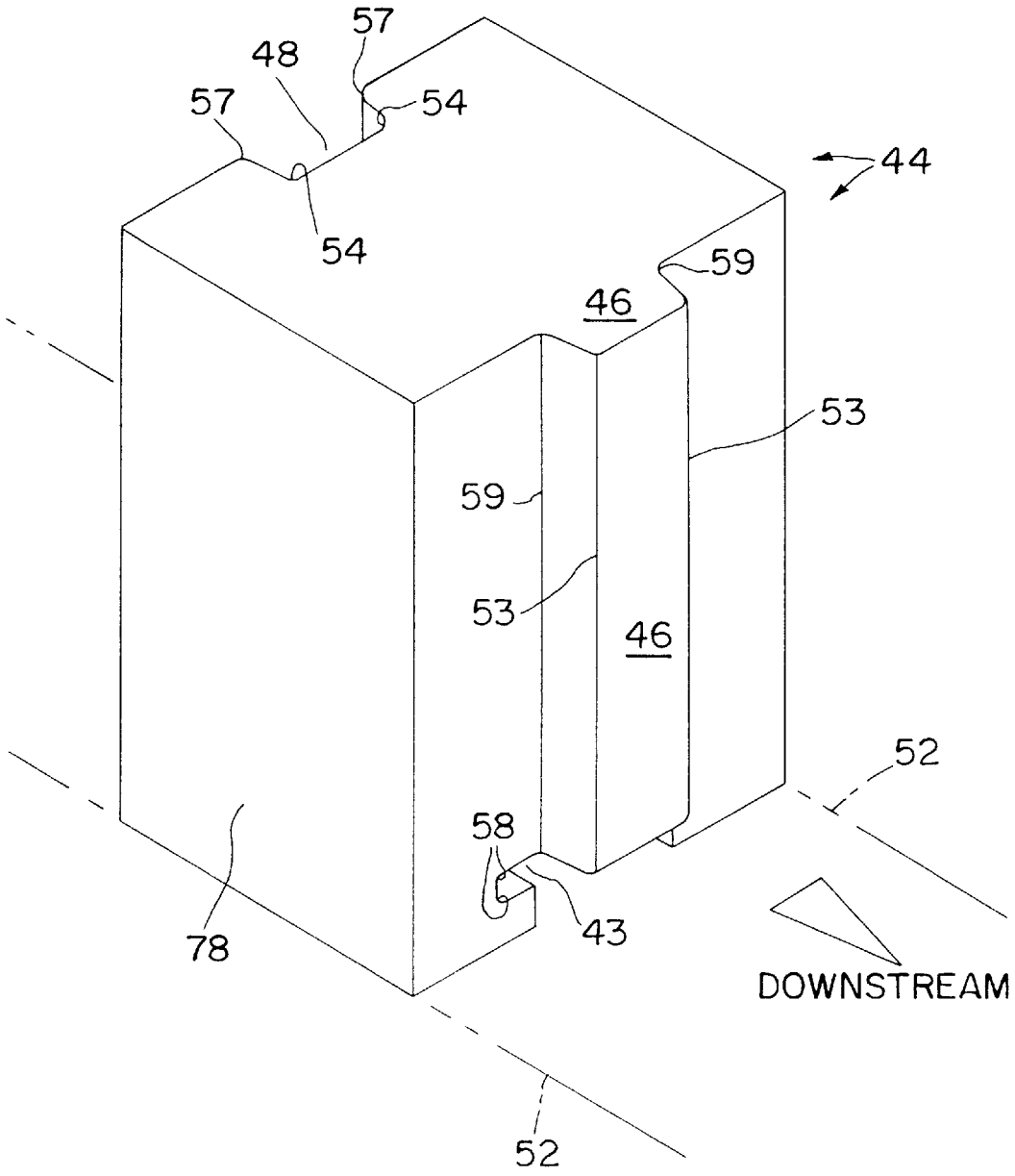
FIG. 5 is an isometric view from above of one of the edge-dam blocks of FIG. 4.
Figure 6:
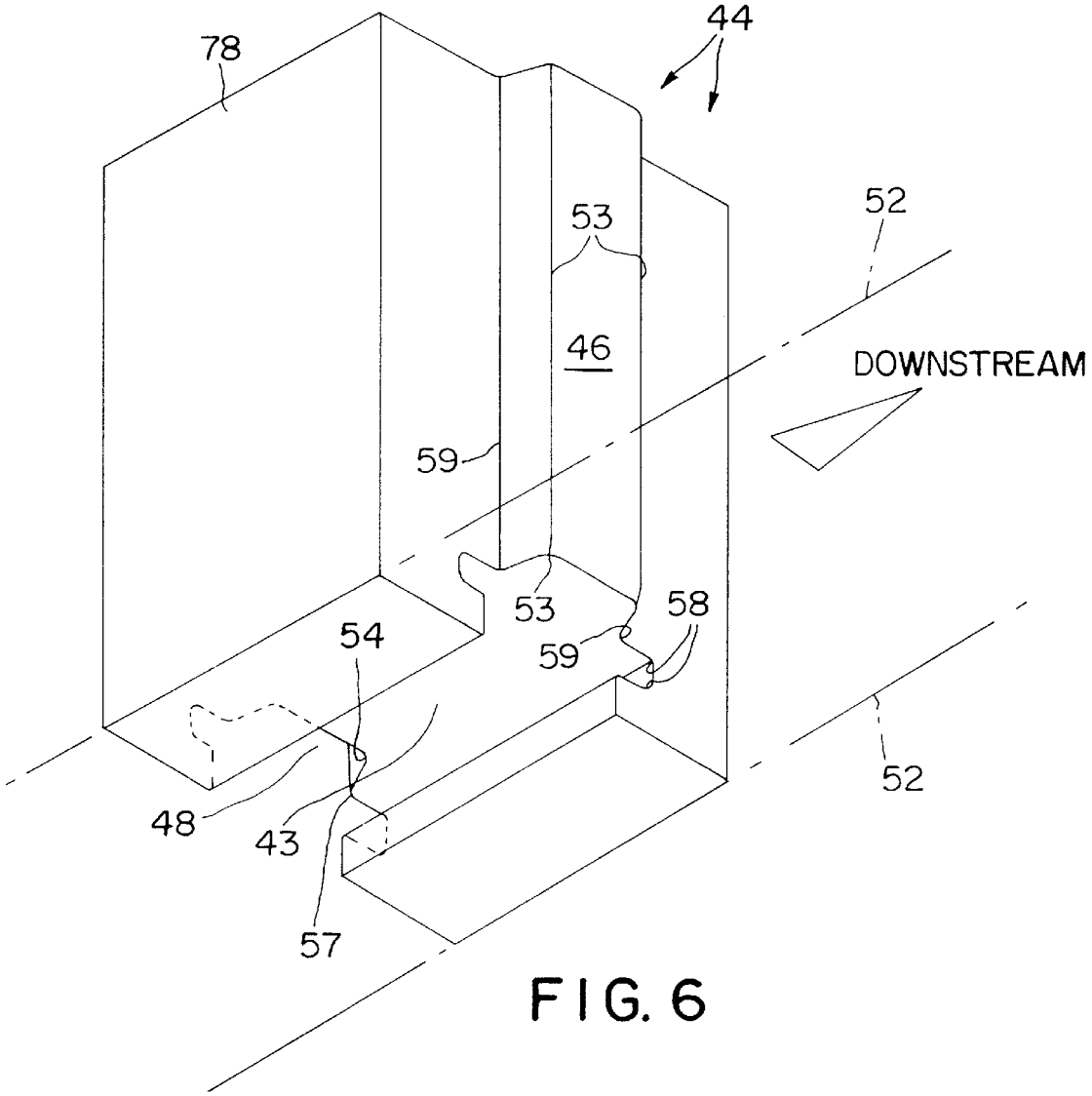
FIG. 6 is an isometric view from below of the edge-dam block of FIGS. 4 and 5.

FIGS. 5 and 6 are isometric views of the same preferred form of edge-dam blocks 44; FIG. 5 is a view obliquely from above and FIG. 6 is a view obliquely from below. T-slot 43 engages the edge-dam-unifying metallic ribbon or strap 42 (FIG. 4). The side with the key is designated here arbitrarily as the downstream side, since it is oriented to face downstream when incorporated into that portion of the edge-dam loops of FIGS. 1 and 11 where they define the edges of the moving mold. Correspondingly, the keyway side or grooved side is designated as the upstream side. The path of motion of the edge-dam blocks is indicated by broken lines 52. Integral key 46 meshes with keyway 48. Root fillets 54 and shoulders 57 of keyway 48 are radiused from 1.2 to 3 millimeters; external edges 53 and root fillets 59 of key 46 need to be radiused correspondingly from 1.2 to 3 millimeters, presumably because of rapid chilling by coolant. The T-slot fillets 58 are radiused to about 0.8 mm. If any of the radii 53, 54, 57, 58, 59 are missing or rough, then cracking from thermal cycling is likely to occur there.

In the event that edge-dam blocks enter the mold region separated slightly from one another, a transverse flow of molten metal may occur between blocks, freezing there into a fin or flashing that remains inconveniently attached to the frozen product. In the prior art, such a fin might be the full width of the edge-dam block. The presence of the integral key 46 in FIGS. 5 and 6 stops the flow of molten metal past itself, resulting in a shorter, less problematical fin or flashing around edge-dam ribbon or strap 42. To block even this residual finning, the key 46 can be shifted sideways (not shown) so that the blockage afforded by such a moved key 46 is presented near to the inward (hot) face 90 of the edge-dam block and so extends downward past the strap 42. Similarly, the key 46 can be greatly widened for enhancing fin-blockage action (not shown).

Figure 6A:
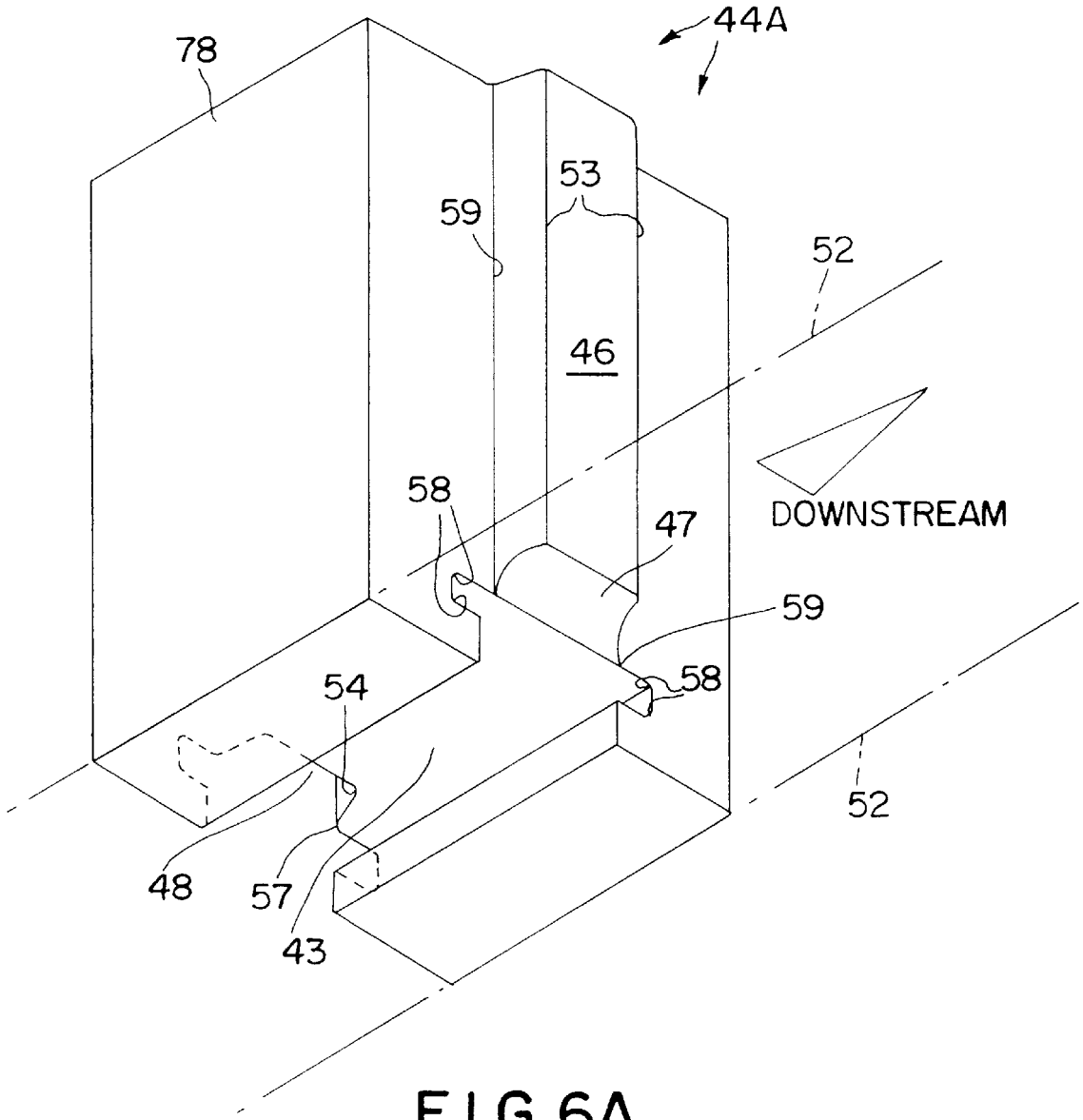
FIG. 6A shows a fillet under the integral key of FIGS. 5 and 6.

FIG. 6A shows a modified edge-dam block 44A having an improvement in stress concentration of the edge-dam block of FIGS. 5 and 6 by the cutting of fillet 47 under the integral key 46.

Figure 12:
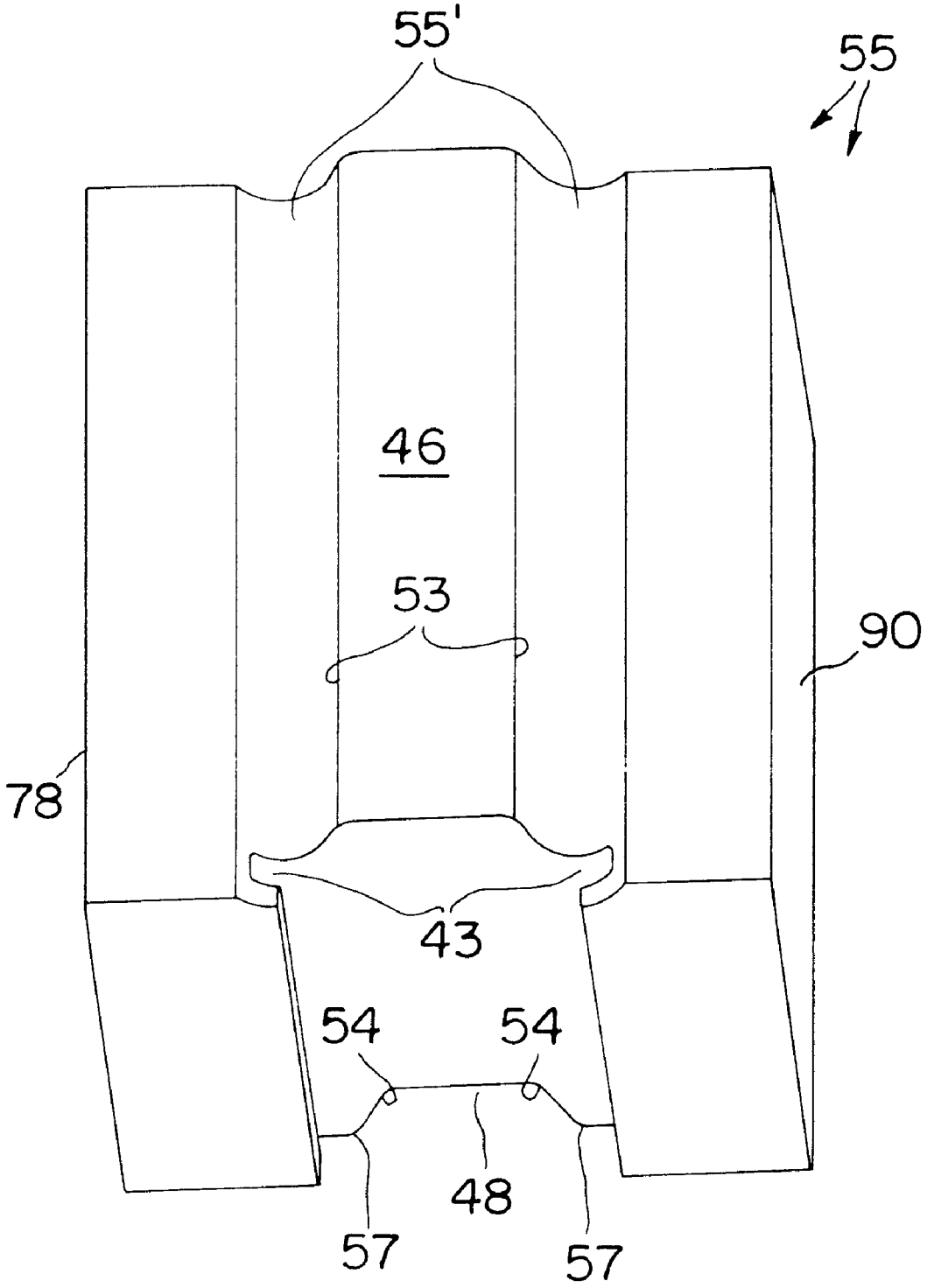
FIG. 12 is a slightly oblique view from below of a dam block with large fillet radii which are undercut or sunken.

It is advantageous under some conditions to have a still larger radius 55' in the internal corners or fillets where the integral key joins the block, a radius of up to 5 millimeters. This is best accomplished by undercutting, sinking the integral key 46 as shown in FIG. 12 on edge-dam block 55.

Figure 6B:
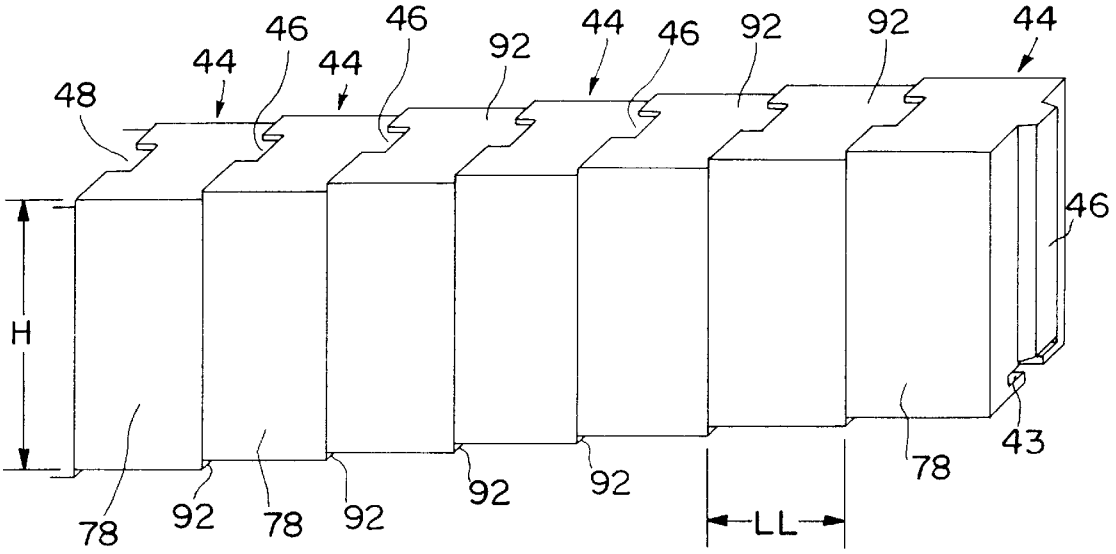
FIG. 6B shows a portion of a line of dam blocks as in FIGS. 4, 5 and 6 all tilted and misaligned in a vertical longitudinal plane. Belts are not shown.

FIG. 6B shows a problem of longitudinal tilting which can occur under certain conditions in the alignment of edge-dam blocks, either of edge-dam blocks 40 of the prior art or of keyed edge-dam blocks of the present invention, for example in the alignment of keyed edge-dam blocks 44, 44A, or 55. In FIG. 6B we see the keyed edge-dam blocks 44 all tilted in the same direction, i.e., in a vertical longitudinal plane, presenting voids 92 through which molten metal may penetrate and freeze into troublesome fins or flashing. The belts are not shown in this view. The tilting problem has not been significantly encountered unless the edge-dam blocks were of substantially less longitudinal length-to-height ratio than shown on say FIG. 8, where LL is the longitudinal length and H Is the height. For the edge-dam blocks shown in FIG. 8, the ratio LL/H is about 0.65.

Figure 8:
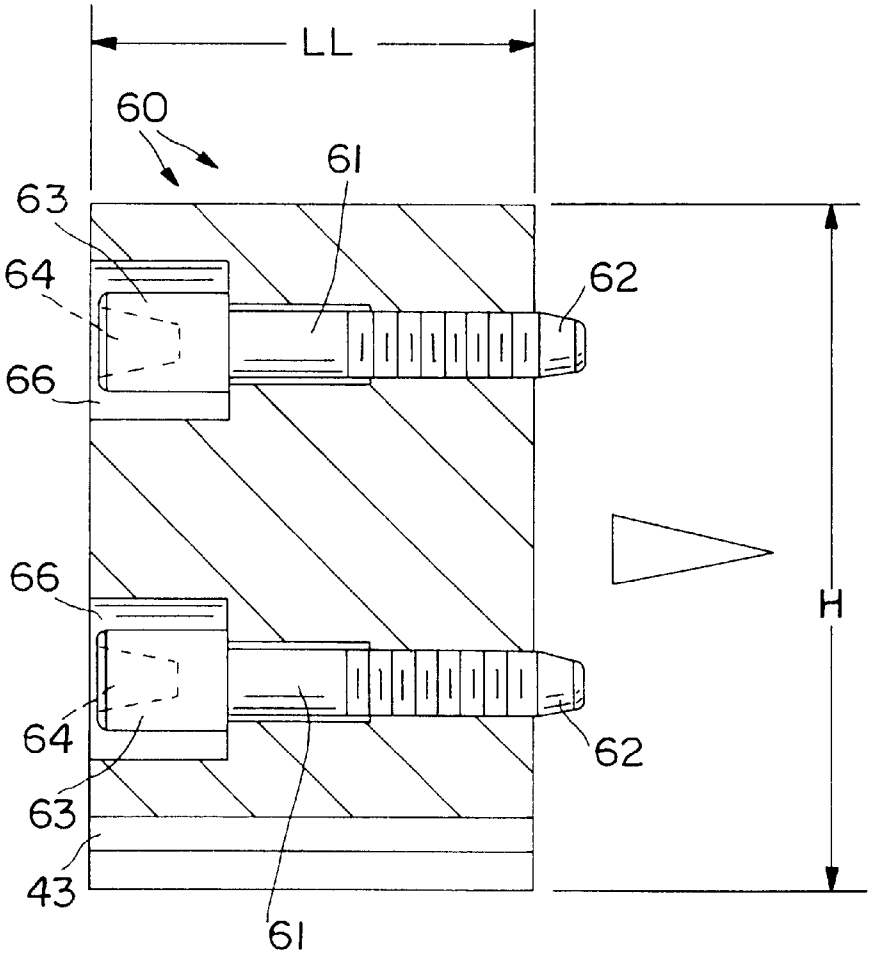
FIG. 8 is a cross-sectional side elevation view of the edge-dam block of FIG. 7. The section is shown as 8—8 in FIG. 7.
Figure 7:
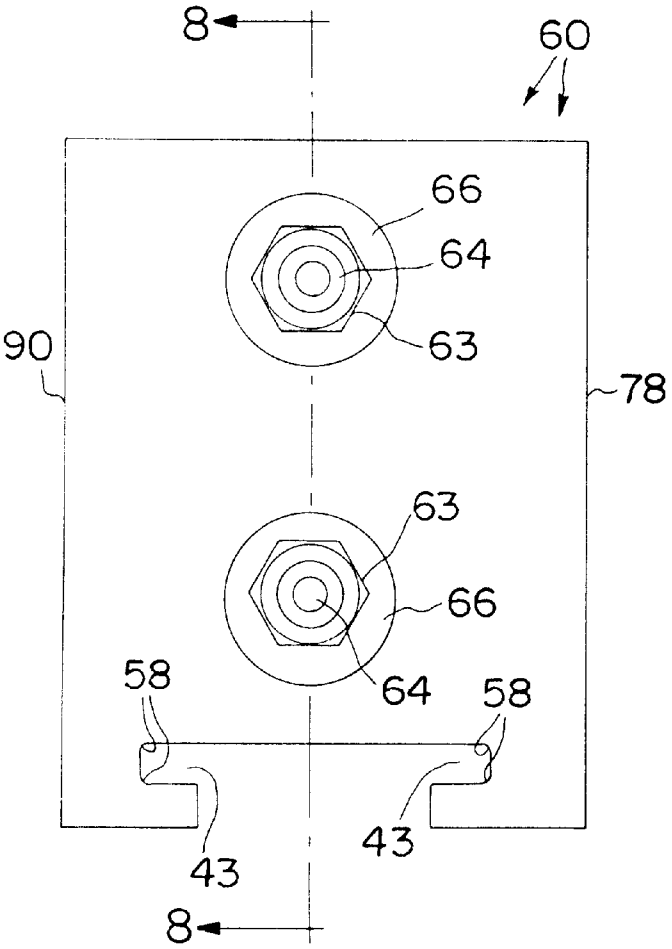
FIG. 7 is a transverse elevation view of an edge-dam block utilizing two alignment pins and seen from the socket side.
Figure 9:
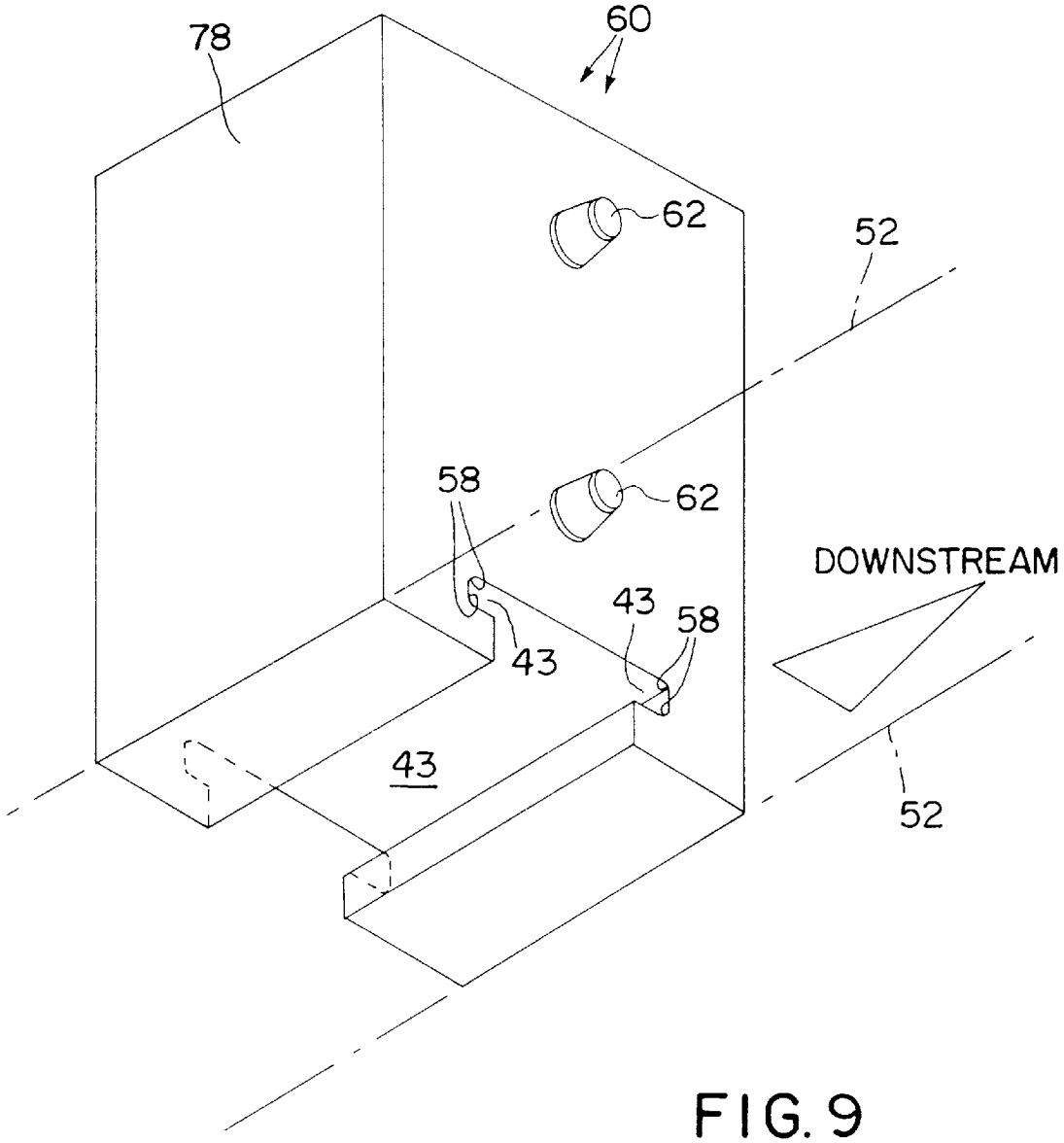
FIG. 9 is an isometric view from below and from the pin side of an edge-dam block utilizing two alignment pins.

An alternate form 60 of interlocking edge-dam blocks addresses this tilting problem and is shown in FIGS. 7, 8 and 9. These pin-located edge-dam blocks each employ a pair of screwed austenitic stainless-steel pins 61 instead of a key and keyway. Tapered points 62 fit into sockets 64 in the heads 63 of the identical screw-pins 61 in the next edge-dam block. This pins-engaging-sockets configuration resists and controls twisting, lateral (transverse) displacement and also resists and controls tilting in the vertical longitudinal plane; (such vertical longitudinal tipping Is shown in FIG. 6B); the vertical key 46 resists twisting and lateral (transverse) displacement, i.e., resists lateral displacement or lateral slippage of one block laterally relative to its adjacent block. For extra duty, pins 61 are made of chrome 400-series stainless steel and magnetized to attract each other.

Various shapes of the abutting faces of edge-dam blocks can each of them embody the invention. Most generally, one abutting face comprises a protrusion, while the mating face of the abutting block comprises a corresponding recess, while any leakage of molten metal past their abutting faces is prevented. The requirements of the abutting faces are stated in somewhat abstract terms as follows. (1) The downstream faces are preferably each to have a molten-metal-sealing, practically determinate relationship with the upstream faces such that, when the assembled edge-dam blocks are pushed together to abut, they are (a) not mutually twistable nor are they (b) detrimentally slippable against each other. Nor are they (c) able to leak molten metal when properly assembled into a continuous-moving-belt metal-casting machine. Further, (2) all such edge-dam blocks in an edge-dam chain are to be functionally identical. That is to say, they all are to be interchangeable in that each downstream abutting face is, at its every functionally relevant point, orthogonally equidistant from its own upstream abutting face as measured in an orthogonal direction parallel to the direction of the pass line. This is illustrated by the parallel arrows 70 of equal length in FIG. 4, which are to be taken as representative of substantially the entire configuration of each whole block. Each abutting face is to constitute a matrix for the functional portion of its mating abutting face. All abutting faces are to be of mutually complementary shape along those edges where leakage or intrusion of molten metal is to be prevented. However, those mutually facing areas which are not important to mutual alignment, and which are not important to sealing against the intrusion of molten metal, need not touch each other. In those areas, there may be allowed clearances, open spaces as in the needful case of the sockets 66 for receiving the heads 63 of the pins in FIG. 8.

Why did we say above that the edge-dam blocks are "practically" determinate in relation to one another and not "detrimentally" slippable against one another? Because a tilting as illustrated in FIG. 6B of the edge-dam blocks 44 in the direction of movement of the belts 22, 24 and edge dams 32 has not become a serious problem; hence, the plan of matching a vertically keyed face to a vertical keyway in the mating face as described above is a useful and advantageous configuration. In practice, other forces within the continuous casting machine and usage of usual block configuration ratios LL/H greater than about 0.65 have prevented significant longitudinal tilting. The overall result is to present to the molten metal an aligned, mutually interlocked surface which is free from tilts, steps or twists.

Figure 10:
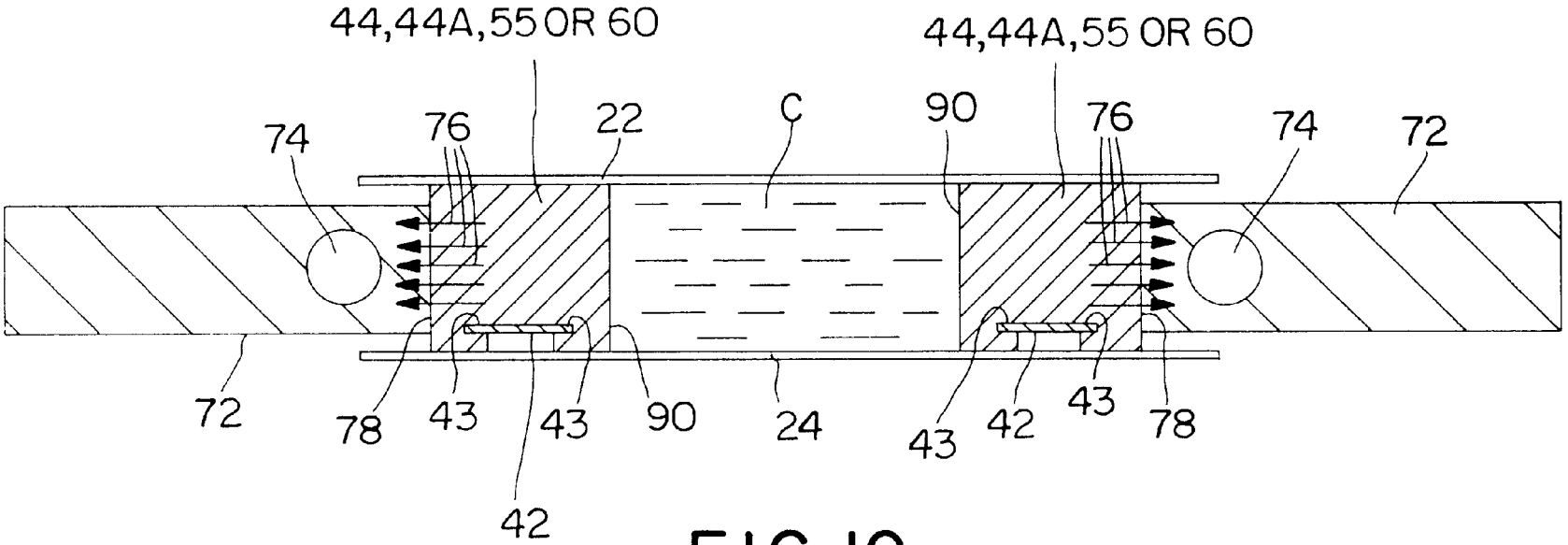
FIG. 10 is a cross-section of the mold region of a twin-belt continuous bar-casting machine showing the prior-art cooled side guides for the edge dams. The section is as taken at 10—10 in FIG. 1.

There are edge-dam guides 72, also known as side guides and shown in cross section in FIG. 10. These are employed to guide the path of the edge dams despite the pressure of the metallostatic head of molten metal in the mold region. A second function of the side guides is to assist in the cooling and freezing of the cast bar product while the bar freezes from the outside inward. To this end, these edge-dam guides keep the edge-dam blocks in contact with the product. A water passage 74 drilled into the edge-dam guide extracts the heat so conducted to the edge-dam guides 72. As shown by heat-transfer arrows 76, this cooling function resulting from heat-flow 76 is greatly facilitated by the reliable alignment of the dam blocks 44, 44A, 55 or 60 together with reliable contact against the guide 72 of substantially the entire guide-facing surface 78 of each dam block, in the manner afforded by the present invention. The uniform contact afforded by this predetermined accurate alignment provided by the keying engagement of abutting blocks enables faster and more uniform cooling of the freezing bar product with resulting improvement in quality of cast product.

TENSION CONTROL

Figure 11:
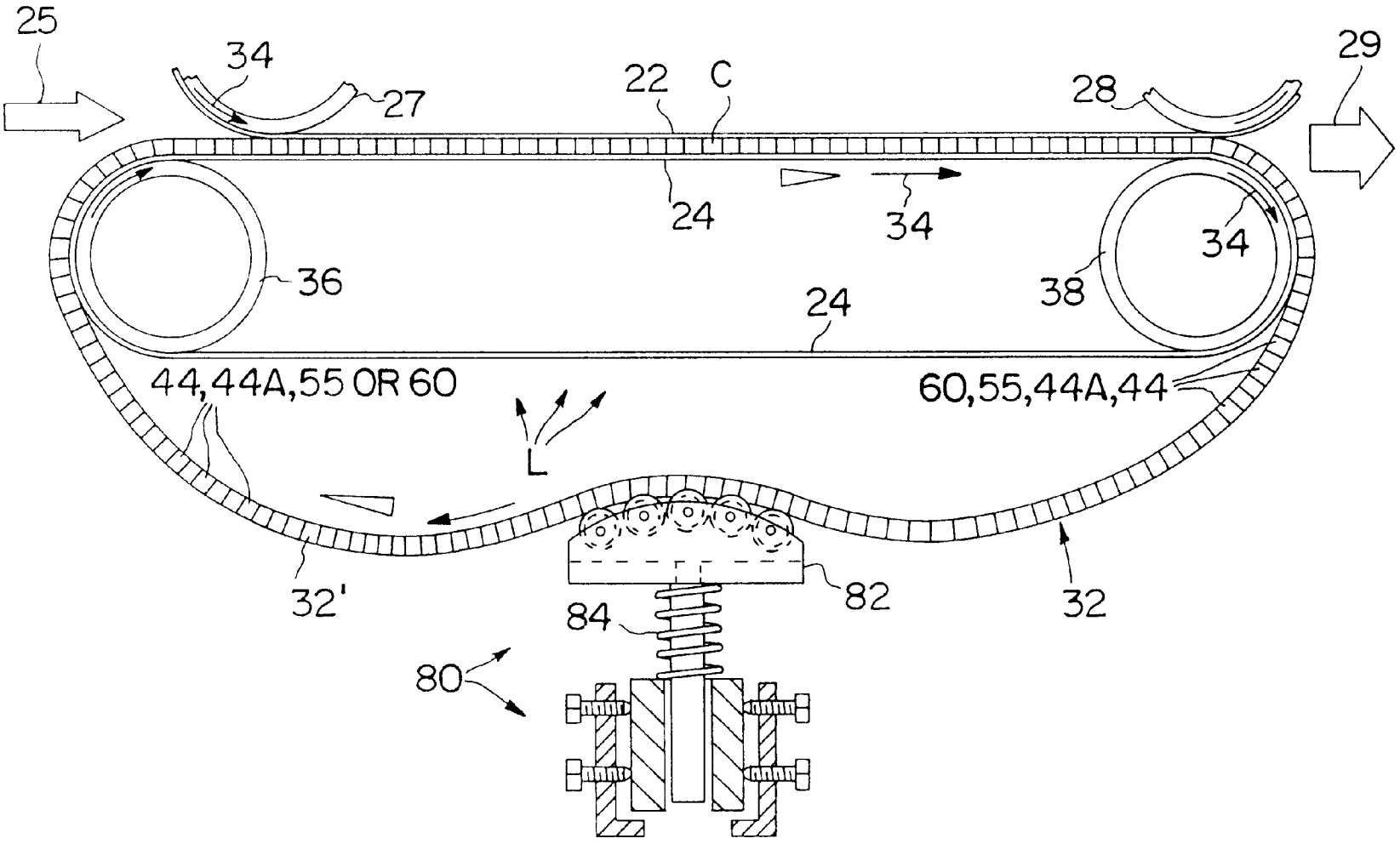
FIG. 11 is a side elevational view corresponding to the lower portion of FIG. 1, showing schematically an upward-acting prior-art "back-breaker" device for maintaining zero slack between the edge-dam blocks in a chain.

FIG. 11 is a side view of an endless looped edge dam 32 which is altered in its course by "backbreaker" mechanism 80. The object is to keep the edge-dam blocks 44 etc. snugly against one another during casting and to do so despite the heat expansions and contractions undergone by the edge-dam blocks as they circulate through the mold region C of the casting machine. To this end, the backbreaker 80, as we call it, is to move its roller head 82 in a plane of the looped edge dam up to a higher position during startup than the roller head 82 will assume later when the dam blocks that it tenses in the looped edge dam are quite hot and thus all expanded and in need of more room. The operation of this upward-acting backbreaker is described in U.S. Pat. Nos. 3,865,176 and 4,155,396, both patents of Doompas et al., assigned to the same assignee as the present invention and incorporated herein by reference. The principle of shortening the effective length of the looped edge-dam by deflecting its course is shown in FIG. 3 of each of these referenced patents.

The backbreaker roller head 82 is adjustable by other means than by the spring 84 shown in FIG. 11. Another way is described in U.S. Pat. No. 4,934,441 of Wood et al. which is assigned to the same assignee as the present invention and incorporated herein by reference. In its FIGS. 3 and 4 is shown a hydraulically operated elevating mechanism for a more evolved version of an upward-acting backbreaker. A load cell (not shown) may be added to weigh the force applied against the looped edge dam for the purpose of automatic control of edge-dam slack and tension.

Edge-dam blocks are routinely cooled by water sprays (not shown) applied to the return reach 32' of the edge-dam chain (FIG. 1). The hot inside face 90 of the blocks e.g., of block 55 in FIG. 12, is most seriously stressed by the cooling water applied there, causing cracks to appear in that face and even splitting along outside edges elsewhere. The confinement of cooling water mainly to the outside face 78 of the edge-dam blocks mitigates these conditions.

Although specific presently preferred embodiments of the invention have been disclosed herein in detail, it is to be understood that these examples of the invention have been described for purposes of illustration. This disclosure is not to be construed as limiting the scope of the invention, since the described methods and apparatus may be changed in details by those skilled in the art of continuous casting of metals, in order to adapt these methods and apparatus to be useful in particular casting machines or situations, without departing from the scope of the following claims. For instance, the foregoing discussion has been in terms of a nearly horizontal twin-belt casting machine having upper and lower carriages, whereas the invention may be described and embodied in casting machines operating at any angle from horizontal to vertically downward. Again, the invention can be described and embodied in terms of single-belt casting machines having a relatively flat casting region along a path of large radius, with the shape of the edge-dam blocks being expressed in corresponding radial coordinates. Yet further, the orientation of the edge-dam blocks can be reversed as to downstream vs. upstream from that shown herein.

We claim:

1. Edge-dam blocks suitable for assembly by mounting the blocks on an elongated flexible tension member slidable along such tension member with abuttable upstream faces oriented toward abuttable downstream faces of adjacent blocks for forming an endless edge dam for revolving in a preselected path for inward sides of the blocks to define a boundary of a moving-mold casting region for keeping molten metal in the casting region, each such edge-dam block having both an abuttable upstream face and an abuttable downstream face, each such edge-dam block comprising:

an abuttable upstream face meshing in mating relationship with an abuttable downstream mating face of an adjacent block;

an abuttable downstream face meshing in mating relationship with an abuttable upstream mating face of an adjacent block; and said meshing in mating relationship between abuttable mating faces of adjacent blocks is spaced away from the inward sides of the blocks.

2. Edge-dam blocks as claimed in claim 1, in which:

blocks for forming the endless edge dam have an overall configuration identical with a plurality of other blocks for forming the endless edge damn.

3. Edge-dam blocks as claimed in claim 1, in which:

said abuttable upstream faces have at least one recess of mutually complementary shape with respect to abuttable downstream faces;

said abuttable downstream faces have at least one protrusion of mutually complementary shape with respect to abuttable upstream faces; and said recess and protrusions on the abuttable upstream and downstream faces of the blocks are spaced away from the inward faces of the blocks for minimizing intrusion of molten metal between abuttable faces of adjacent blocks.

4. Edge-dam blocks as claimed in claim 1, in which:

the abuttable upstream faces have at least one mechanical element selected from a group of mechanical elements consisting of mechanical keys and keyways;

the abuttable downstream faces have at least one mechanical element selected from said group and being of mutually complementary shape with respect to the mechanical elements of the abuttable upstream faces; and the mechanical elements are provided in portions of adjacent blocks near but spaced away from their inward sides for minimizing intrusion of molten metal between adjacent blocks.

5. Edge-dam blocks as claimed in claim 1, wherein:

said abuttable upstream mating faces during meshing with abuttable downstream mating faces of adjacent blocks prevent relative translational motion between the blocks in a direction toward or away from said moving-mold casting region.

6. Edge-dam blocks as claimed in claim 1, in which:

one of the abuttable mating faces comprises at least one elongated keyway orientable perpendicular to a casting belt while the other of the abuttable mating faces comprises at least one corresponding elongated integral key-like tongue orientable perpendicular to the casting belt and being engageable in meshing relationship into and being removable from the elongated keyway of an adjacent block.

7. Edge-dam blocks as claimed in claim 6, in which:

external edges of key-like tongues are radiused;

root fillets of key-like tongues are radiused;

shoulders of each keyway are radiused;

root fillets of each keyway are radiused; and such radiused regions have radii in a range between about 1.2 millimeters and about 3 millimeters.

8. Edge-dam blocks as claimed in claim 1, in which:

one of the abuttable mating faces comprises at least two round pins having protruding tapered ends; and the other of the abuttable mating faces comprises at least two corresponding tapered recesses for receiving in mating relationship the protruding tapered ends of the two pins of an adjacent block.

9. An endless looped edge dam comprising a multiplicity of edge-dam blocks as claimed in claim 1 and comprising at least one flexible unifying tensile member having said blocks mounted thereon and being slidable along said tensile member and wherein the inward sides of the blocks are smooth, in which:

abuttable upstream mating faces of said edge-dam blocks in said endless looped edge dam are meshing with abuttable downstream mating faces of adjacent edge-dam blocks throughout a portion of said endless looped edge dam for preventing relative translational motion between the blocks in a direction toward and away from the moving-mold casting region for aligning the smooth inward sides of the blocks for providing a smooth boundary of a moving mold casting region.

10. An endless looped edge dam for providing a moving boundary of a moving mold casting region in a continuous casting machine wherein the edge dam has at least one unifying tensile member, further comprising:

a multiplicity of edge-dam blocks mounted on and being slidable along said tensile member;

each edge-dam block mounted on said tensile member having an abuttable upstream face meshable in mating relationship with an abuttable downstream face of an adjacent block;

each edge-dam block mounted on said tensile member having an abuttable downstream face meshable in mating relationship with an abuttable upstream face of an adjacent block; and the meshing in mating relationship between abuttable upstream faces and abuttable downstream faces resists slippage of the blocks relative to adjacent blocks laterally toward and away from the moving mold casting region.

11. The method of shaping edge-dam blocks for improving their alignment when they are slidably strung upon a flexible tension member to form an endless looped flexible edge dam for use in a continuous-moving-belt metal-casting machine, comprising the steps of:

shaping abuttable upstream and abuttable downstream surfaces of said edge-dam blocks for providing meshing interengagement between adjacent blocks when adjacent blocks are pushed together against one another, and shaping smooth inside surfaces of said blocks, followed by steps of:

stringing such shaped edge-dam blocks upon a flexible tension member with said abuttable upstream and abuttable downstream surfaces facing each other and with said smooth inside surfaces all facing in a same direction;

fastening together ends of said flexible tension member to complete an endless looped flexible edge dam;

while a portion of said endless looped flexible edge dam is travelling along a casting region in the metal-casting machine with said smooth inside surfaces facing toward the casting region, pushing together in meshing interengagement a succession of the edge-dam blocks in said portion, thereby:

mutually aligning said succession of meshing edge-dam blocks to be free from intervening tilts, offsets, or twists, for presenting their aligned inside surfaces as a smooth boundary extending along said portion of said endless looped flexible edge dam for the casting of smooth-sided metal product against it.

12. A method of continuously casting metal in a continuous-moving-belt metal-casting machine having a moving mold region and employing a pair of endless edge dams for defining opposite side boundaries of the moving mold region wherein each of the endless edge dams comprises a multiplicity of edge-dam blocks slidably strung upon a flexible tensile member, the method comprising steps of:

shaping mateable upstream and downstream surfaces of said edge-dam blocks with mutually complementary shape for being interengageable in mating relationship between adjacent blocks when pushed against one another and shaping smooth inside surfaces of said edge-dam blocks, followed by steps of;

stringing such shaped edge-dam blocks upon a flexible tensile member with said mateable upstream and downstream surfaces facing each other and with said smooth inside surfaces all facing in a same direction and fastening together ends of said flexible tensile member for completing an endless flexible edge dam;

assembling the pair of such endless edge dams into a continuously-moving-belt casting machine with said smooth inside surfaces of the edge-dam blocks of both of the pair of endless flexible edge dams facing toward the casting region; and during casting of molten metal in said moving mold region, moving portions of the pair of endless edge dams along opposite sides of the moving mold region and pushing together in mating relationship the mateable upstream and downstream surfaces of the edge-dam blocks in said portions of the endless edge dams for mutually aligning said edge-dam blocks in such interengaged mating relationship for presenting said smooth inside surfaces as smooth side boundaries extending along opposite sides of the moving mold for casting smooth-sided product.

13. The method as claimed in claim 12 wherein said moving mold region extends along a casting plane, further comprising steps of:

leaving some empty space along each of the flexible tensile members for providing slack between mateable upstream and downstream surfaces of some of the edge-dam blocks in each endless edge dam; and absorbing said slack between the mateable upstream and downstream surfaces of the edge-dam blocks by flexibly deflecting a course of each edge dam in a preselected respective plane which is perpendicular to the casting plane for mutually aligning pushed-together mateable upstream and downstream surfaces of adjacent blocks in interengaged mating relationship along said portions of the pair of endless edge dams, thereby presenting said smooth inside surfaces as smooth side boundaries extending along opposite sides of the moving mold for casting smooth sided product, and thereby also minimizing intrusion of molten metal between said pushed-together upstream and downstream mateable surfaces of adjacent blocks in interengaged mating relationship along opposite sides of the moving mold.

14. A flexible edge dam for use in a belt-type continuous metal-casting machine for use as a boundary of a moving mold for retaining molten metal being cast in the moving mold, said flexible edge dam comprising:

a flexible tensile member;

a multiplicity of edge-dam blocks strung on said tensile member and being slidable along said tensile member;

adjacent edge-dam blocks in said edge dam having adjacent mateable surfaces facing each other;

one adjacent mateable surface of the edge-dam blocks having at least one protrusion;

another adjacent mateable surface of the edge-dam blocks having at least one recess for snugly receiving said protrusion therein; and said adjacent mateable surfaces being engageable together in mating relationship for preventing slippage between adjacent blocks toward and away from the metal being cast.

15. A flexible edge dam as claimed in claim 14, in which:

said protrusion is an elongated key extending vertically along the mateable surface of the block;

said recess is an elongated keyway extending vertically along the mateable surface of the adjacent block for snugly receiving the elongated key therein;

said elongated key is removably snugly received in said elongated keyway; and said elongated key and said elongated keyway are spaced away from the metal being cast.

16. A flexible edge dam as claimed in claim 15, in which:

external edges and root fillets of the key are rounded, and shoulders and root fillets of the keyway are rounded; and rounded portions of the key and keyway have radii between about 1.2 mm and about 3.0 mm.

17. A flexible edge dam as claimed in claim 16, in which:

the key is undercut at its lower portion.

18. A flexible edge dam as claimed in claim 14, in which:

said edge-dam blocks in said multiplicity of edge-dam blocks are identical one with another in overall configuration.

19. A flexible edge dam for providing a movable boundary of a mold movable from upstream to downstream for continuous casting of molten metal in the movable mold, said flexible edge dam comprising:

a multiplicity of edge-dam blocks;

such edge-dam blocks having a mateable upstream surface and a mateable downstream surface;

the mateable upstream surface of such edge-dam blocks being mateable in key and keyway meshing relationship with the mateable downstream surface of adjoining abutting edge-dam blocks;

the mateable downstream surface of such edge-dam blocks being mateable in key and keyway meshing relationship with the mateable upstream surface of adjoining abutting edge-dam blocks;

each functional point on the mateable upstream surface of such edge-dam blocks is equidistant from each functional point on the mateable downstream surface of such edge-dam blocks as measured in a direction parallel with said movable boundary of the movable mold; and the key and keyway meshing relationship between mateable upstream and downstream surfaces of such edge-dam blocks is located away from the molten metal in the movable mold.

20. Edge-dam blocks as claimed in claim 1, wherein the moving-mold casting region has at least one boundary defined by a revolving casting belt which moves along the casting region, in which:

one of the abuttable faces includes at least one keyway orientable perpendicular to the casting belt in a region in which the casting belt is moving along the casting region;

the other of the abuttable faces includes at least one integral key orientable perpendicular to the casting belt in said region for being removably engageable in the keyway in an abuttable face of an adjacent block;

said other abuttable face includes a pair of parallel undercut fillets extending along opposite sides of the key; and each of said undercut fillets has a radius in a range from about 3 millimeters to about 5 millimeters.

21. Edge-dam blocks as claimed in claim 1, wherein the moving-mold casting region has at least one boundary defined by a revolving casting belt which moves along the casting region, in which:

one of the abuttable faces includes at least one elongated keyway orientable perpendicular to the casting belt in a region in which the casting belt is moving along the casting region;

the other of the abuttable faces includes at least one elongated integral key orientable perpendicular to the casting belt in said region for being removably engageable in the keyway in an abuttable face of an adjacent block;

said elongated keyway has a width in a direction toward and away from the molten metal, and said width of the elongated keyway is about one-third of an overall width of the edge-dam block in said direction; and said elongated key has a width in a direction toward and away from the molten metal, and said width of the elongated key is about one-third of said overall width of the edge-dam block.

22. An endless looped edge dam as claimed in claim 10, wherein:

abuttable upstream faces of the edge-dam blocks have at least one mechanical keying element selected from a group of mechanical keying elements consisting of protrusions and recesses of mutually complementary configuration;

abuttable downstream faces of the edge-dam blocks have at least one mechanical keying element selected from said group and the selected mechanical keying elements of the abuttable downstream faces are of mutually complementary configuration with respect to the mechanical keying elements of the abuttable upstream faces for meshing therewith in removable mating relationship.

23. An endless looped edge dam as claimed in claim 22, wherein:

said protrusions are elongated key-like tongues orientable perpendicular to a casting belt;

said recesses are elongated grooves orientable perpendicular to the casting belt; and said elongated key-like tongues are meshable in mating relationship into said elongated grooves and are removable from said elongated grooves.

24. An endless looped edge dam as claimed in claim 22, wherein:

said protrusions are pairs of tapered points;

said recesses are pairs of tapered sockets; and said pairs of tapered points are engageable in mating relationship into said tapered sockets and are removable from said tapered sockets.

25. An endless looped edge dam as claimed in claim 24, wherein:

said tapered points and sockets are magnetized for attracting each other.

26. A method of continuously casting metal in a continuous-moving-belt metal-casting machine having a moving mold region and employing a pair of endless edge dams for defining opposite side boundaries of the moving mold region wherein each of the endless edge dams comprises a multiplicity of edge-dam blocks slidably strung upon a flexible tensile member, the method comprising steps of:

providing said edge-dam blocks with mateable upstream and downstream surfaces for meshing together in mating relationship between adjacent blocks when pushed together;

providing said edge-dam blocks with guide-facing outside surfaces;

guiding edge-dam blocks in said pair of endless edge dams moving along opposite sides of the moving mold region by meshing such edge-dam blocks together in mating relationship by pushing them together and sliding their guide-facing surfaces along a pair of cooled stationary side guides extending along opposite sides of the moving mold region and being positioned outside of the respective guided edge-dam blocks, thereby mutually aligning said edge-dam blocks in pushed together mating relationship presenting their guide-facing surfaces with reliable contact sliding along the respective side guides for enabling faster and more uniform cooling of the freezing cast metal product.

27. A flexible edge dam as claimed in claim 14, in which:

the moving mold carries along a pass line the metal being cast;

each edge-dam block in said multiplicity has a mateable upstream surface and a mateable downstream surface; and as measured in a direction parallel with the pass line every functional point on the mateable downstream surface of such edge-dam blocks in said multiplicity is equidistant from every functional point on the mateable upstream surface of such edge-dam blocks.

* * * * *